US010876237B1

(12) United States Patent
Rosenbach

(10) Patent No.: US 10,876,237 B1
(45) **Date of Patent: *Dec. 29, 2020**

(54) TURNED EDGE FABRIC CIRCLE APPLIQUÉS

(71) Applicant: Ellen Rosenbach, North Palm Beach, FL (US)

(72) Inventor: Ellen Rosenbach, North Palm Beach, FL (US)

(73) Assignee: ELLEN'S QUILTS II, LLC, North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/018,460

(22) Filed: Sep. 11, 2020

Related U.S. Application Data

(63) Continuation of application No. 16/738,838, filed on Jan. 9, 2020, now Pat. No. 10,808,344.

(60) Provisional application No. 62/790,275, filed on Jan. 9, 2019.

(51) Int. Cl.
*D05C 1/04* (2006.01)
*D05B 97/02* (2006.01)

(52) U.S. Cl.
CPC ..... *D05C 1/04* (2013.01); *D05B 97/02* (2013.01)

(58) Field of Classification Search
CPC ... D05C 1/00; D05C 1/02; D05C 1/04; D05C 9/04; D05C 9/10; D05B 97/00; D05B 97/02; D05B 97/12; D05B 11/00; G01B 3/14; G09B 19/20; A41H 1/00; A41H 3/00
See application file for complete search history.

(56) References Cited

U.S. PATENT DOCUMENTS 1,062,525 A 5/1913 Ward
2,532,329 A * 12/1950 Premo ..... A41H 3/002 33/474
2,666,935 A 1/1954 Gilbert et al.
2,993,250 A * 7/1961 Decker ..... A44B 1/24 24/113 R (Continued)

FOREIGN PATENT DOCUMENTS

CN 203110780 U * 8/2013
GB 2107368 A 4/1983
WO WO 2007037587 A1 * 4/2007

*Primary Examiner* — Ismael Izaguirre
(74) *Attorney, Agent, or Firm* — Ansari Katiraei LLP; Arman Katiraei; Sadiq Ansari

(57) ABSTRACT

Turned edge fabric appliqués are produced using a first template whose perimeter corresponds to a desired shape of a finished appliqué of certain size, and a second template having a corresponding opening so that the perimeter of the first template fits in the opening with a determined gap between the templates. The perimeter of the second template corresponds to an appliqué of the desired shape but a size larger than said certain size, and the second template fits in a corresponding opening in a third template to obtain the appliqué of larger size. A fabric piece is placed by the first template into the opening in the second template, and an exposed edge of the piece projects through the gap above the first template to define a seam allowance which is ironed atop the first template. The template is then withdrawn from the opening and from the ironed seam allowance.

16 Claims, 4 Drawing Sheets

(56) References Cited

U.S. PATENT DOCUMENTS

| | | | | |
|---|---|---|---|---|
| 3,864,791 | A * | 2/1975 | Bishop | A44B 11/001 24/163 R |
| 4,230,164 | A | 10/1980 | Mericle | |
| 5,065,523 | A | 11/1991 | Chiang | |
| 5,141,140 | A | 8/1992 | Moffett-Hall | |
| 5,531,176 | A | 7/1996 | Johnson | |
| 6,286,224 | B1 | 9/2001 | Lewis | |
| 6,443,081 | B1 | 9/2002 | Quint | |
| 6,446,571 | B1 | 9/2002 | Sloot | |
| 8,074,384 | B2 | 12/2011 | Kuwabara | |
| 8,393,093 | B2 | 3/2013 | Cleveland et al. | |
| 2012/0137532 | A1* | 6/2012 | Yeh | A41H 3/002 33/562 |
| 2014/0315158 | A1 | 10/2014 | Wischusen, III | |
| 2015/0352741 | A1* | 12/2015 | Nabity | B26D 1/0006 83/698.91 |

* cited by examiner

TURNED EDGE FABRIC CIRCLE APPLIQUÉS

CROSS REFERENCE TO RELATED APPLICATION

This application is a continuation of U.S. NonProvisional patent application Ser. No. 16/738,838 filed on Jan. 9, 2020, titled TURNED EDGE FABRIC CIRCLE APPLIQUES, which claims priority under 35 U.S.C. § 119(e) of U.S. Provisional Patent Application No. 62/790,275 filed Jan. 9, 2019, titled Fabric Circle Appliqués, the entire contents of which are incorporated by reference.

BACKGROUND OF THE INVENTION

Field of the Invention

The present invention relates generally to quilting, and particularly to a technique and kit for making perfect turned edge fabric circle and other shape appliqués for quilts.

Discussion of the Known Art

Many publications, articles, and websites are known which address the problem of producing ready-to-appliqué circles for quilts from fabric pieces. See, for example, www.connectingthreads.com/karen-kay-buckley-s-perfect-circles/p/81770, and U.S. Pat. No. 5,531,176 (Jul. 2, 1996).

Moreover, there have been many attempts to improve accuracy of cutting pieces of fabric to make quilts. For example, U.S. Pat. No. 4,779,346 which discloses a template of a rectangular transparent sheet marked with a rectangular grid of lines and oblique lines to assist in sewing, quilting etc. to achieve a selected pattern; U.S. Pat. No. 4,608,939 which discloses a template for hand sewing to ensure equal spacing of stitches; and U.S. Pat. No. 4,945,642 which describes a quilting template for guiding a cutting tool to assist in quilting operations.

Popular methods of making circle appliqués include (1) needle turn appliqué, (2) circular freezer paper templates with starch, (3) templates with glue, (4) making running stitches along an edge of the fabric piece, gathering up the stitches encasing the edges of the piece about a circular template, starching and pressing the fabric on the template, and removing the template, (5) fusing wherein the fabric piece is cut to the exact size of the desired circle with no seam allowance. The cut piece is fused to stabilize the appliqué and help minimize raveling. It is then attached by machine or hand using the desired stitch. The process makes the appliqué stiff causing unfavorable reviews, and (6) English paper piecing which is only suitable for hand sewing, wherein the quilter hand bastes fabric around a desired paper shape and whipstitches it next to a matching desired shape. The finished larger shape is then attached to the quilt. The paper must be removed from the back of the appliqué by cutting through the background fabric which is not only time consuming and tedious, but also weakens the final quilt.

U.S. Pat. No. 5,141,140 (Aug. 25, 1992) discloses apparatus for preparing a quilt appliqué including a template in the shape of a desired appliqué, and a rectangular shape plate having an opening of the same shape as that of the template. See also U.S. Pat. No. 5,791,062 (Aug. 11, 1998) which discloses a flat sheet template that facilitates making conventional quilting units, and U.S. Pat. No. 7,814,832 (Oct. 19, 2010) which relates to a method of preparing fabric for cutting and/or sewing.

Notwithstanding the known art, there is a need for a technique and a kit for producing fabric appliqués in multiple sizes, wherein the kit is easy to use, portable, long lasting, and of an elegant configuration requiring no prethought or preparation on the part of the user. There is also a need for a kit for making turned edge circle appliqués whose diameters range from as small as ⅜ inch to two inches or more.

SUMMARY OF THE INVENTION

According to the invention, a method of making a fabric appliqué includes providing a first template the perimeter of which is dimensioned and formed to correspond to a desired shape of a finished appliqué of a certain size, and providing a second template having an opening dimensioned and formed so that the perimeter of the first template fits within the opening in the second template with a determined gap between the first and the second templates. The second template has a perimeter dimensioned and formed to correspond to the desired shape but of a size larger than said certain size, and the second template fits within a corresponding opening in a third template to obtain an appliqué of the larger size.

A fabric piece is cut so as to leave an exposed edge beyond the perimeter of the first template when placed between the first template and the opening in the second template, and the first template places the piece into the opening so that the exposed edge of the piece projects above the template through the gap between the first and the second templates to define a seam allowance. The seam allowance is ironed flat atop the first template, the first template is removed with the fabric piece from the opening in the second template, and the first template is withdrawn from the ironed seam allowance to obtain the finished appliqué.

According to another aspect of the invention, a kit for making fabric appliqués in multiple sizes, includes at least a first, a second, and a third template. The first template is dimensioned and formed to fit in a central opening in the second template with such clearance as to form a determined gap between the first and the second templates through which a seam allowance of a first fabric piece can pass. The second template is dimensioned and formed to fit in a central opening in the third template with enough clearance to form a determined gap between the second and the third template through which a seam allowance of a second fabric piece can pass.

The perimeter of the first template corresponds to a desired shape of a finished appliqué of a certain size, and the perimeter of the second template corresponds to a finished appliqué having the desired shape but of a size larger than said certain size, wherein the second template fits in the central opening in the third template to obtain the appliqué of larger size.

The gap between the first and the second templates is dimensioned so that when (i) a fabric piece of a size that extends beyond the central opening in the second template to define a seam allowance is placed between the first and the second templates, and (ii) the first template places the fabric piece into the central opening in the second template, the seam allowance projects through the gap and above the first template to be ironed flat atop the template, and the first template is removable from the opening so that the template can be withdrawn from the ironed seam allowance to obtain the finished appliqué.

If the templates are in the form of flat rings or washers as in the illustrated embodiment, then the outside diameters of the templates may be selected from among, e.g., ⅜ in., ½ in., ⅝ in., ¾ in., ⅞ in., 1 in., 1¼ in., and up to 2.25 in. Note that the smallest (or the first) template in the kit does not require a central opening.

For a better understanding of the invention, reference is made to the following description taken in conjunction with the accompanying drawing and the appended claims.

BRIEF DESCRIPTION OF THE DRAWING FIGURES

DETAILED DESCRIPTION OF THE INVENTION

The present invention enables finished fabric appliqués of a desired shape to be produced in one or more sizes using the following items:

Scissors;

Quilting weight fabric;

Iron;

Liquid Starch or Sizing

Small Paintbrush or Dauber

A kit of appliqué templates as described herein.

Figure 1:
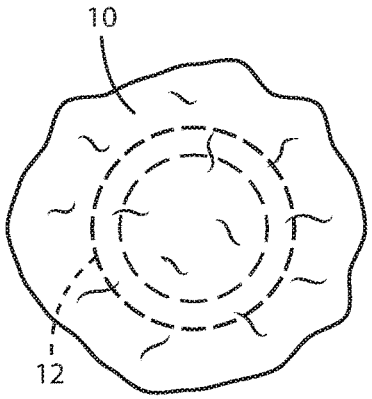
FIG. 1 shows a rough cut fabric piece placed over a second template having a central circular opening.
Figure 2:
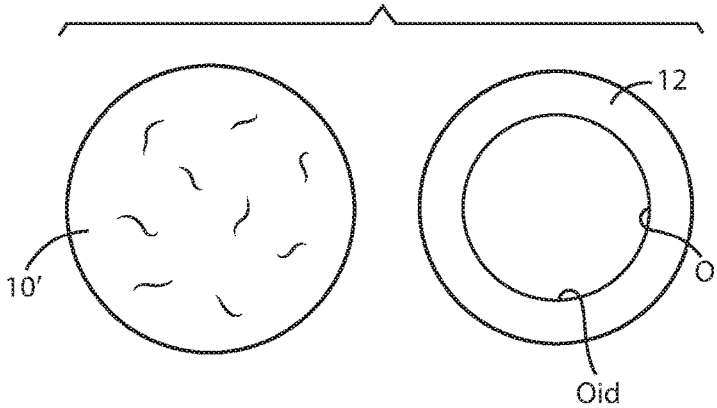
FIGS. 2 and 3 show the fabric piece when trimmed to form a circle the diameter of which extends beyond the opening in the second template to form a seam allowance.

FIG. 1 shows a rough cut fabric piece 10 of, e.g., 100% quilting cotton, and FIG. 2 shows a second template 12 which, in the present embodiment, is in the form of a circular flat washer or ring having a central opening O whose inside diameter $O_{ID}$ corresponds to the outside diameter of a desired fabric circle appliqué. The overall area of the fabric piece 10 should be sufficient to cover the central opening O in the second template 12, and extend beyond the opening O to define a seam allowance. That is, when placed over the second template 12, the fabric piece 10 is preferably trimmed near the outer circumference of the template to form a circular fabric piece 10' shown in FIG. 2. The fabric piece 10' may then be painted with a liquid starch using a paint brush or dauber.

Alternatively, instead of trimming the rough cut fabric piece 10 near the outer circumference of the second template 12, the piece 10 can be trimmed to form the circular piece 10' after a central portion of the rough cut piece 10 is placed in the opening O in the template 12 by a first template 14, as described below.

Figure 3:
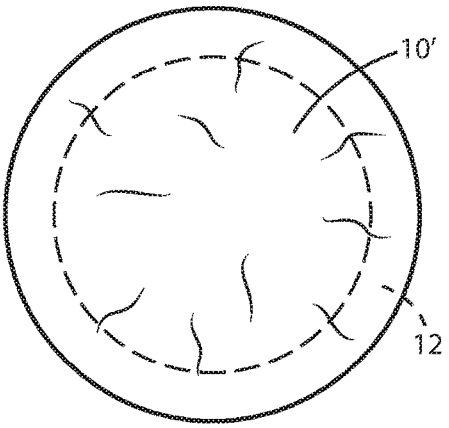
Figure 4:
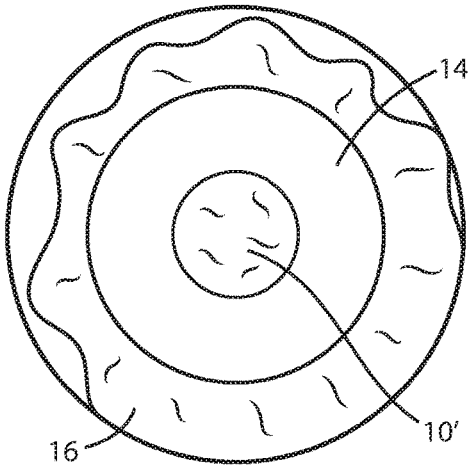
FIG. 4 shows a first template urging the fabric piece into the opening in the second template.
Figure 5:
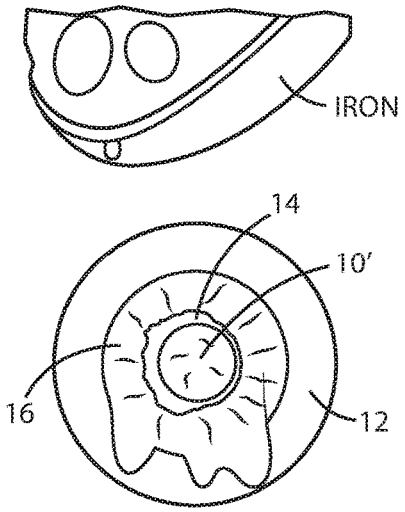
FIGS. 5 and 6 show the seam allowance being ironed atop the first template shown in FIG. 4, after the seam allowance projects through a gap formed between the templates.
Figure 6:
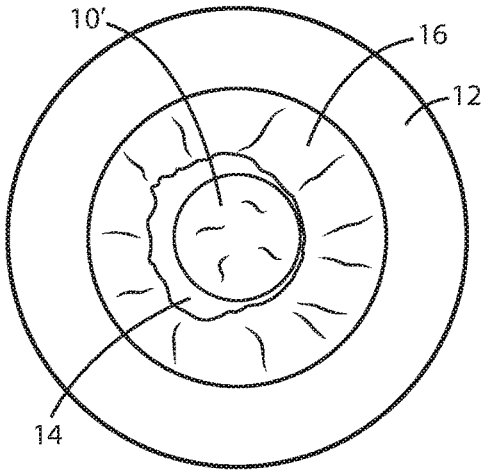
Figure 7:
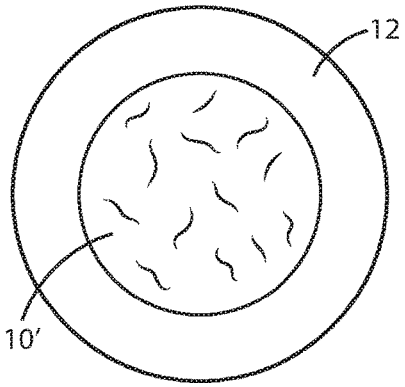
FIG. 7 shows the fabric piece as seen on the sides of the templates opposite the sides shown in FIGS. 5 and 6.

The painted fabric piece 10' is disposed face down on the second template 12 as seen in FIG. 3. The first template 14, whose outer diameter is slightly less than the inner diameter $O_{ID}$ of the second template 12, is placed over the fabric piece 10' concentric with the template 12. The first template 14 then places the fabric piece 10' in the opening in the template 12 as shown in FIG. 4, thus causing the seam allowance 16 to protrude through a determined gap between the two templates. The seam allowance 16 is then ironed atop the first template 14, toward the center of the template as shown in FIGS. 5 and 6. The two templates 12, 14 are turned over together as shown in FIG. 7, and the exposed side of the fabric piece 10' is also ironed.

Figure 8:
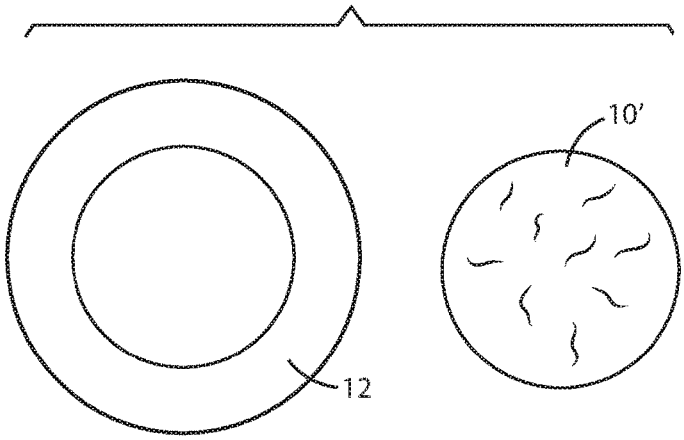
FIGS. 8 and 9 show the first template removed together with the fabric piece from the opening in the second template.
Figure 9:
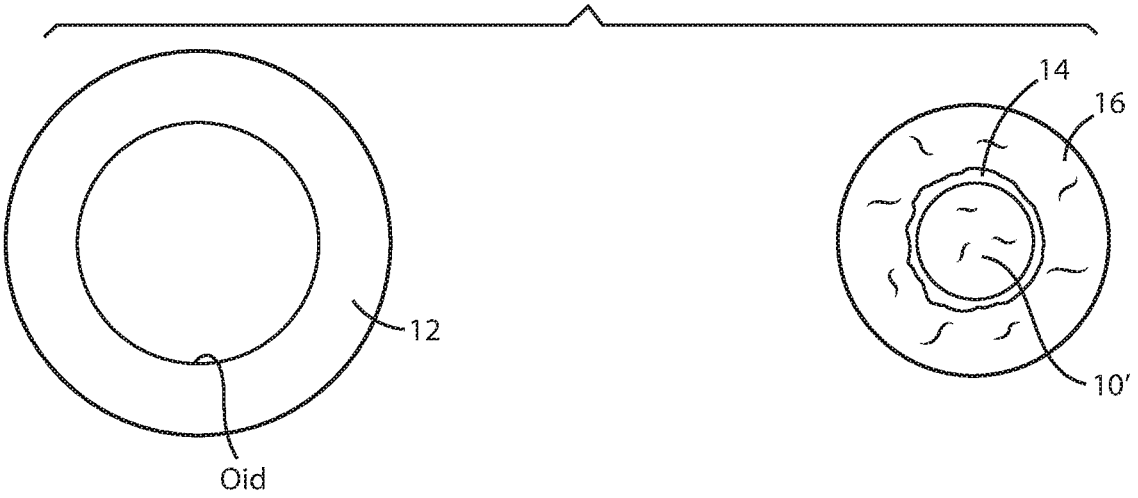
Figure 10:
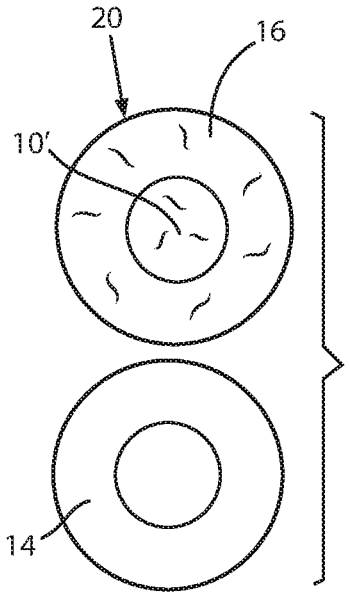
FIG. 10 shows the first template withdrawn from the ironed seam allowance to obtain a finished circle appliqué.

After the templates 12, 14 are allowed to cool, the first template 14 and overlying fabric piece 10' are urged out of the opening O in the second template 12 as seen in FIGS. 8 and 9. The first template 14 is then withdrawn from beneath the ironed seam allowance 16 to obtain a finished fabric circle appliqué 20. The appliqué 20 may be pressed again if desired. The templates 12, 14 may be formed of metal, or a suitable heat resistant non-metallic material.

According to another aspect of the invention, a set or kit for producing finished fabric appliqués of various shapes and sizes contains at least first, second, and third templates, wherein the first template can fit within a central opening in the second template with enough clearance to form a determined gap between the first and the second templates through which a seam allowance of a first fabric piece can pass (see, e.g., FIG. 4). Moreover, the second template can fit in an opening in the third template with enough clearance to form a determined gap between the second and the third template through which a seam allowance of a second fabric piece can pass. If the templates are in the form of flat rings or washers as in the present embodiment, then the outside diameters of the first templates may include, for example, ⅜ in., ½ in., ⅝ in., ¾ in., ⅞ in., 1 in., 1¼ in., and 1½ in. Note that the smallest (or the first) template in the kit does not require a central opening.

Figure 12:
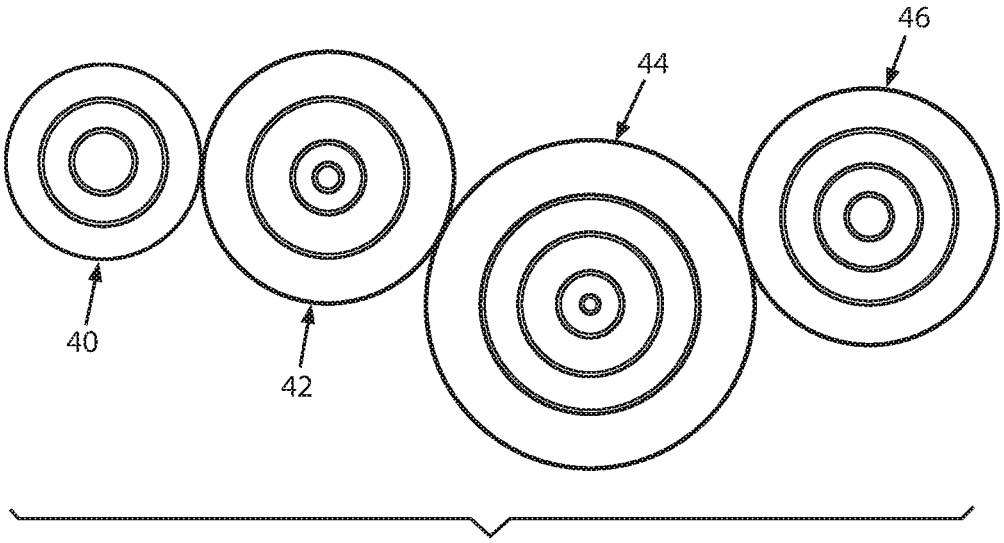
FIG. 12 shows four kits of templates each one of which can produce fabric appliqués of one, two, or three different sizes.

Also note that by providing multiples of each size template in a kit of concentric templates as in FIG. 12, a quilter can make a corresponding number of appliqués of the same size without having to wait for only one pair of templates to cool down after ironing before making the next appliqué. The templates can also be color coded so that the quilter can readily know which two templates will pair or nest within one another to make an appliqué of a desired size.

Using the inventive technique disclosed herein, the time required to produce a large number of fabric appliqués can be reduced substantially. For example, the inventor was able to construct 106 circle appliqués in under two hours. Quilters therefore need not abandon creative projects involving the application of a large number of small circles, for example, along the edge of a quilt only because of the amount of time consumed by prior techniques to do so.

Figure 11:
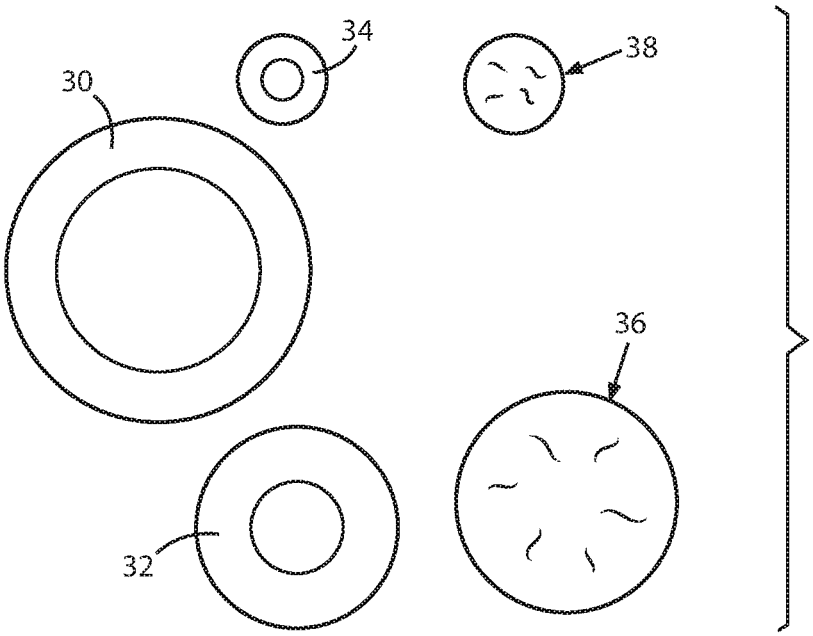
FIG. 11 shows a kit of three templates that can be used to produce fabric appliqués of two different sizes.

FIG. 11 shows a kit of three templates 30, 32, 34 that can produce finished fabric circle appliqués having an outside diameter (O.D.) of either one-half inch (appliqué 38), or 1⅛ inches (appliqué 36). In this example, template 30 has an O.D. of about 1¾ inches and an inner diameter (I.D.) of 1⅛ inches. Template 32 has an O.D. of about 1⅛ inches and an I.D. of one-half inch, and template 34 has an O.D. of about one-half inch.

To produce the appliqué 38 of one-half inch diameter, template 34 is used to place a cut fabric piece into the central opening in template 32. To produce the appliqué 36 of 1⅛ inches O.D., template 32 is used instead to place a cut fabric piece into the central opening in template 30.

FIG. 12 shows an example of four different kits 40, 42, 44, 46 containing two, three, and four concentric templates for producing finished fabric circle appliqués of various diameters, according to the invention.

The following Table lists examples of kits each of which contains four templates in the form of flat circular rings for producing fabric circle appliqués of three different diameters. Each template was formed of stainless steel 0.048+/−0.001 inch thick, and with such outside and inside diameters as to form a gap of approximately 0.0055 inch when any two templates in a given kit are nested or paired with one another to produce a finished appliqué.

| | OD | ID |
|---|---|---|
| KIT 1 | | |
| Template 1 | 0.375 | 0.125 |
| Template 2 | 0.875 | 0.386 |
| Template 3 | 1.375 | 0.886 |
| Template 4 | 1.875 | 1.386 |
| KIT 2 | | |
| Template 5 | 0.5 | 0.1875 |
| Template 6 | 1 | 0.511 |
| Template 7 | 1.5 | 1.011 |
| Template 8 | 2 | 1.511 |
| KIT 3 | | |
| Template 9 | 0.625 | 0.1875 |
| Template 10 | 1.125 | 0.636 |
| Template 11 | 1.625 | 1.136 |
| Template 12 | 2.125 | 1.636 |
| KIT 4 | | |
| Template 13 | 0.75 | 0.375 |
| Template 14 | 1.25 | 0.761 |
| Template 15 | 1.75 | 1.261 |
| Template 16 | 2.25 | 1.761 |
| KIT 5 | | |
| Template 1 | 0.375 | 0.125 |
| Template 13 | 0.75 | 0.386 |
| Template 14 | 1.25 | 0.761 |
| Template 15 | 1.75 | 1.261 |

In all cases, the outer template of any two paired templates was found to provide adequate support to hold the inner template securely while the seam allowance is ironed flat atop the inner template, and allowing for maximum manipulation of relatively scant seam allowances.

The present invention is especially useful for quilters who love little circles and berries, but have been discouraged from using them on their quilts because the methods of preparation have been tedious, complicated, and require skill and dexterity. The inventive kits provide a system that overcomes deficiencies in prior methods, thus making sewing and quilting more accessible to beginners and handicapped individuals. It saves time, improves accuracy, and simplifies the preparation steps. It is more economical because it utilizes any scrap of fabric large enough to cover the opening in a desired template. And it is more enjoyable because the results are so perfect.

The kits can be hung on a ring and stored easily in a sewing box or drawer. They will not rust. Multiple templates of the same size enable more than one size appliqué to be made in succession while waiting a brief minute for the templates to cool. Because the templates fit within one another, they can be stored together in a neat column so that the loss of pieces will not be commonplace.

While the foregoing represents preferred embodiments of the present invention, it will be understood by persons skilled in the art that various changes, modifications, and additions can be made without departing from the spirit and scope of the invention.

For example, in addition to stainless steel, the templates may be made from any sturdy rigid material capable of withstanding the heat of a conventional iron without deforming. Further, nesting pairs of the templates may also be dimensioned and formed to produce appliqués of shapes other than circular, e.g., ovals or other geometric shapes.

Accordingly, the invention includes all such changes, modifications, and additions that are within the scope of the following claims.

I claim:

1. A method comprising:

placing a fabric piece over a first template, wherein the first template comprises an inner perimeter exposing an inner opening, and a rigid structure extending a length from the inner perimeter to an outer perimeter;

trimming the fabric piece using the outer perimeter of the first template as a guide, wherein trimming the fabric piece comprises defining a circular uniform seam allowance of equal length for the finished appliqué by cutting the fabric piece around the outer perimeter of the first template;

inserting a second template, with a size that is less than the inner perimeter of the first template and with a shape matching the inner perimeter of the first template, into the inner opening of the first template with a center of the fabric piece underneath the second template and edges of the fabric piece extending over and above the second template from a gap between the first template and the second template; and producing a finished appliqué by pressing the edges of the fabric piece towards a center of the second template.

2. The method of claim 1, wherein producing the finished appliqué comprises ironing the edges of the fabric piece against a backside of the second template that is opposite to a frontside of the second template that is over the center of the fabric piece.

3. The method of claim 2, wherein producing the finished appliqué further comprises withdrawing the second template from the fabric piece.

4. The method of claim 1, wherein producing the finished appliqué comprises flattening the edges of the fabric piece against a backside of the second template with an application of heat or an adhesive.

5. The method of claim 1 further comprising removing the second template with the fabric piece from the first template prior to said producing the finished appliqué.

6. The method of claim 1, wherein the first template corresponds to an annulus with the inner perimeter matching an inner diameter that encircles the inner opening, and with the outer perimeter matching a larger outer diameter.

7. The method of claim 1, wherein the first template corresponds to a washer of a first size, and wherein the second template corresponds to a washer of a smaller second size.

8. The method of claim 1, wherein a height of the first template is equal to a height of the second template.

9. The method of claim 1 further comprising applying starch to a back of the fabric piece, wherein the starch retains the shape of the finished appliqué after said pressing of the edges.

10. The method of claim 1, wherein the finished appliqué is a first size, the method further comprising producing a finished appliqué of a different second size by:

placing a second fabric piece over a third template, wherein the third template comprises an inner perimeter exposing an opening that is larger than the outer perimeter of the first template, and a rigid structure extending a length from the inner perimeter of the third template to an outer perimeter;

trimming the second fabric piece based on the outer perimeter of the third template;

inserting the first template into the opening of the third template with a center of the second fabric piece underneath the first template and edges of the second fabric piece extending over and above the first template from a gap between the first template and the third template;

ironing the edges of the second fabric piece towards a center of the first template.

11. The method of claim 1, wherein the first and second templates are made of a heat resistant rigid material.

12. A kit comprising:

a first template corresponding to a first annulus comprising an inner perimeter exposing an inner opening, and a rigid structure extending a length from the inner perimeter to an outer perimeter, wherein the inner opening is of a shape and size of a finished appliqué, and wherein the length from the inner perimeter to the outer perimeter is equal to a specific length of a uniform seam that creates a flat backside for the finished appliqué; and a second template corresponding to a second annulus that fits inside the first annulus, the second annulus comprising a rigid surface with a size that is less than the inner perimeter of the first template, a shape matching the inner perimeter of the first template, and a height equal to a height of the first template, and wherein the second template inset into the inner opening of the first template with a fabric piece disposed between establishes the shape and size for a front side of the finished appliqué while providing the rigid surface against which the seam allowance is ironed over and around the second template to create the flat backside of the finished appliqué.

13. The kit of claim 12, wherein the first template and the second template are made of stainless steel.

14. A method comprising:

placing a fabric piece over a first template, wherein the first template comprises an inner perimeter exposing an inner opening, and a rigid structure extending a length from the inner perimeter to an outer perimeter, wherein the first template corresponds to an annulus with the inner perimeter matching an inner diameter that encircles the inner opening, and with the outer perimeter matching a larger outer diameter;

trimming the fabric piece using the outer perimeter of the first template as a guide;

inserting a second template, with a size that is less than the inner perimeter of the first template and with a shape matching the inner perimeter of the first template, into the inner opening of the first template with a center of the fabric piece underneath the second template and edges of the fabric piece extending over and above the second template from a gap between the first template and the second template; and producing a finished appliqué by pressing the edges of the fabric piece towards a center of the second template.

15. A method comprising:

placing a fabric piece over a first template, wherein the first template comprises an inner perimeter exposing an inner opening, and a rigid structure extending a length from the inner perimeter to an outer perimeter;

trimming the fabric piece based on the outer perimeter of the first template;

inserting a second template, with a size that is less than the inner perimeter of the first template and with a shape matching the inner perimeter of the first template, into the inner opening of the first template with a center of the fabric piece underneath the second template and edges of the fabric piece extending over and above the second template from a gap between the first template and the second template, wherein the first template corresponds to a washer of a first size, and wherein the second template corresponds to a washer of a smaller second size; and producing a finished appliqué by pressing the edges of the fabric piece towards a center of the second template.

16. A method comprising:

placing a fabric piece over a first template, wherein the first template comprises an inner perimeter exposing an inner opening, and a rigid structure extending a length from the inner perimeter to an outer perimeter;

trimming the fabric piece based on the outer perimeter of the first template;

inserting a second template, with a size that is less than the inner perimeter of the first template and with a shape matching the inner perimeter of the first template, into the inner opening of the first template with a center of the fabric piece underneath the second template and edges of the fabric piece extending over and above the second template from a gap between the first template and the second template, wherein a height of the first template is equal to a height of the second template; and producing a finished appliqué by pressing the edges of the fabric piece towards a center of the second template.

* * * * *